United States Patent [19]

Robinson

[11] Patent Number: 4,891,849

[45] Date of Patent: Jan. 9, 1990

[54] HYDROTHERAPY PATIENT SUPPORT APPARATUS

[76] Inventor: Harry W. Robinson, 8153 West Beard Rd., Perry, Mich. 48872

[21] Appl. No.: 91,298

[22] Filed: Aug. 27, 1987

Related U.S. Application Data

[60] Continuation of Ser. No. 920,726, Oct. 20, 1986, abandoned, which is a division of Ser. No. 784,780, Oct. 7, 1985, abandoned.

[51] Int. Cl.[4] ..... A47K 3/022

[52] U.S. Cl. ..... 4/575

[58] Field of Search ..... 4/571, 572, 573, 575, 4/578

[56] References Cited

U.S. PATENT DOCUMENTS

| | | | |
|---|---|---|---|
| 975,016 | 11/1910 | Burger | 4/575 X |
| 1,758,071 | 5/1930 | Bleustein | 4/572 |
| 1,824,396 | 9/1931 | Erhard et al. | 4/579 |
| 2,460,148 | 1/1949 | Roth | 4/573 X |
| 2,495,482 | 1/1950 | Rogatz | 4/572 X |
| 2,535,259 | 12/1950 | Boyington | 4/572 |
| 2,968,814 | 1/1961 | Ashby . | |
| 3,210,775 | 10/1965 | Jongeneel | 4/575 |
| 3,400,410 | 9/1968 | Sallinger . | |
| 3,548,815 | 12/1970 | Everston . | |
| 3,583,001 | 6/1971 | Steinhoff | 4/575 |
| 3,595,224 | 7/1971 | Walter | 4/573 X |
| 3,648,296 | 3/1972 | Craft et al. . | |
| 3,730,176 | 5/1973 | Miller . | |
| 3,857,118 | 12/1974 | Mamo et al. . | |
| 3,865,104 | 2/1975 | Paulson et al. . | |
| 3,981,484 | 9/1976 | James . | |
| 4,090,507 | 7/1978 | Van Horn . | |
| 4,099,522 | 7/1978 | Alenares . | |
| 4,230,364 | 10/1980 | Parker . | |
| 4,338,691 | 7/1982 | Gaffney | 4/573 X |

FOREIGN PATENT DOCUMENTS

| | | | |
|---|---|---|---|
| 0019089 | 8/1904 | Australia | 4/579 |
| 3103424 | 9/1982 | Fed. Rep. of Germany | 4/578 |
| 0431084 | 6/1911 | France | 4/573 |
| 0245217 | 10/1946 | Switzerland | 4/575 |
| 0002059 | of 1904 | United Kingdom | 4/579 |
| 2135185 | 8/1984 | United Kingdom | 4/572 |

*Primary Examiner*—Charles E. Phillips
*Attorney, Agent, or Firm*—Ian C. McLeod

[57] ABSTRACT

The invention pertains to a support apparatus for supporting a patient's head, back and buttocks on an inclined angle in the range of 10° to 35° while immersed in a hydrotherapy tub or tank. The back support apparatus includes a tubular frame with flexible webbing stretched across and attached to the tubular frame. A pair of legs are attached to the frame for supporting a patent on an inclined angle in the tub. Another variation of the back support apparatus includes a pair of support straps attached to the tubular frame and the tank for supporting a patient on an inclined angle in the range of 10° to 35° while immersed in the tube or tank.

8 Claims, 2 Drawing Sheets

HYDROTHERAPY PATIENT SUPPORT APPARATUS

This application is a division of application Ser. No. 784,780, filed Oct. 7, 1985. This is a continuation of co-pending application Ser. No. 920,726, filed on Oct. 20, 1986.

BACKGROUND OF THE INVENTION (1) Field of the Invention

The present invention relates to a patient support apparatus for supporting the head, back and buttocks of the patient on an inclined angle while immersed in a hydrotherapy treatment tub or tank. In particular, the present invention relates to a support apparatus which includes flexible webbing attached to a frame for supporting a patient's head, back and buttocks in a single plane, preferably on an inclined angle range of 10° to 35° while immersed in a hydrotherapy tub or tank.

(2) Prior Art

Prior art hydrotherapy devices which support the entire body of the patient in a hydrotherapy tank are known; however they do not provide effective treatment to the back and lower torso of the patient. These prior art devices employ a plinth which supports the entire body of the patient horizontally. These devices can also include mechanical platforms which raise and lower the plinth and patient into a hydrotherapy tub or tank. Another type of prior art device for use in hydrotherapy treatment is a webbed lounge chair placed in a tub or tank. The webbed chairs generally support the patient's entire body and are ineffective for treating the back or lower torso region of the patient because of the bending at the waist. The problem is to provide the back and buttocks of the patient in a single plane at an inclined angle from horizontal close to horizontal such that the muscles in the entire back are relaxed and such that the water impinges on the back.

Various devices are presently available to aid in treating invalids or the handicapped in hydrotherapy tubs or tanks. U.S. Pat. No. 2,968,814 to Ashby describes nylon tapes attached to a frame on a lounge chair with a manual operating system for lowering a patient into a tub. U.S. Pat. No. 3,400,410 to Sallinger describes a lightweight frame for lowering and elevating an incapacitated person in a bathtub. U.S. Pat. No. 3,548,814 to Everston describes a therapeutic pool which is equipped with a lounge chair with flexible webbing which holds the buttocks and back so that they bend at the waist. U.S. Pat. No. 3,730,176 to Miller describes a plinth having a water tight sleeve preventing contamination in a hydrotherapy treatment system. U.S. Pat. No. 3,857,118 to Mamo et al describes a plinth which lowers and elevates a patient into or from a bathtub with a mechanical hoist. U.S. Pat. No. 3,865,104 to Paulson et al describes a hoist controlled plinth having a plastic sleeve at each end connected by a connecting device which in turn connects to a hoist. U.S. Pat. No. 4,230,364 to Parker describes a chair with flexible porous webbing which supports a seated occupant in a supine position to form a pocket for a seated patient with the back and buttocks bent. U.S. Pat. No. 4,338,691 to Gaffney describes a bathtub aid having a fabric web attached to a frame to form a pocket for a seated patient with the back and buttocks bent by which a handicapped patient can be transported to a bathtub without attendant handling of the entire weight of the patient.

Other U.S. Patents more distantly related to the present invention include: 3,648,296 to Craft et al; 3,981,484 to James; 4,090,507 to VanHorn; 4,099,522 to Alenares.

OBJECTS

It is therefore an object of the present invention to provide a support apparatus which supports the head, back and buttocks of a patient in a single plane at an acute angle enabling water to impinge through open spaces in nylon webbing and onto the head, back and buttocks. It is further an object of the present invention to provide a support apparatus with a sealed tubular frame which is lightweight and portable for patient use. These and other objects will become increasingly apparent by reference to the following description and the drawings.

In the Drawings

The aforementioned effects and advantages of the present invention will be appreciated from the following description and accompanying drawings wherein:

FIG. 1 is a perspective view of the patient support apparatus of the present invention, which illustrates flexible webbing 14 stretched across and attached to a tubular frame 11, and more particularly illustrating a pair of legs 16 mounted on the tubular frame 11 for supporting the frame in tub 101 at an inclined angle;

Figure 1:
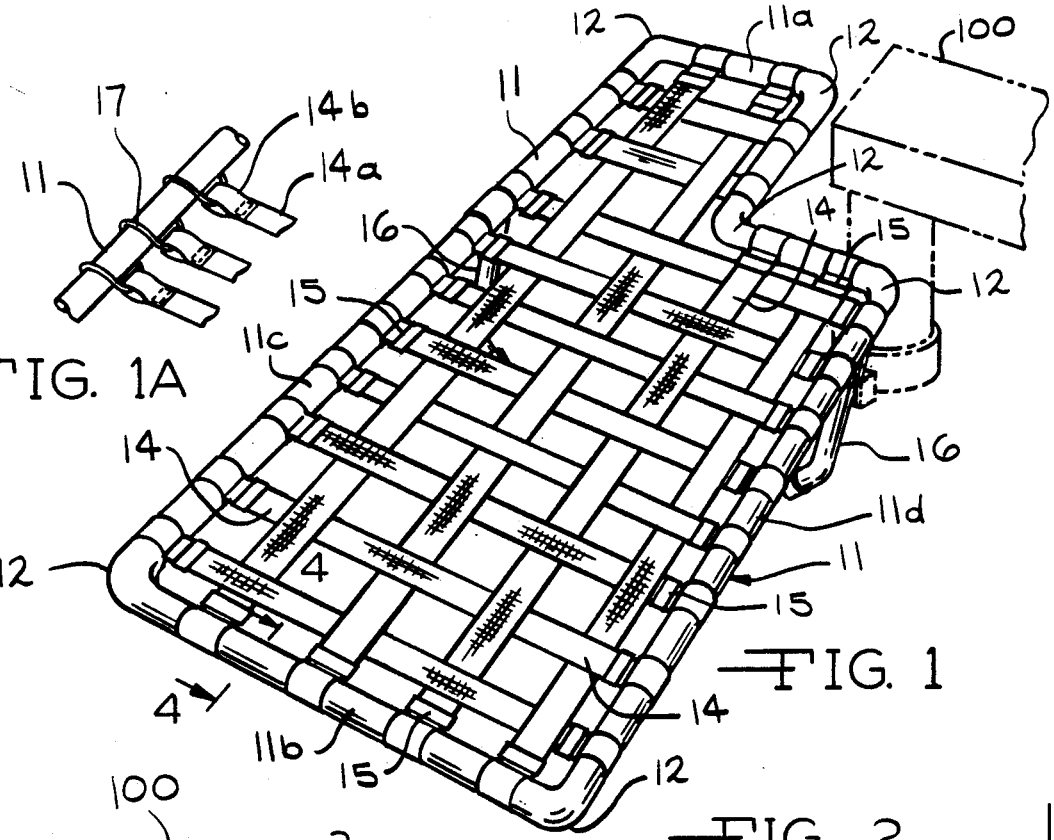
FIG. 1A shows an alternate method of attaching the webbing **14*a* to the frame 11 using a rope 17**.
Figure 2:
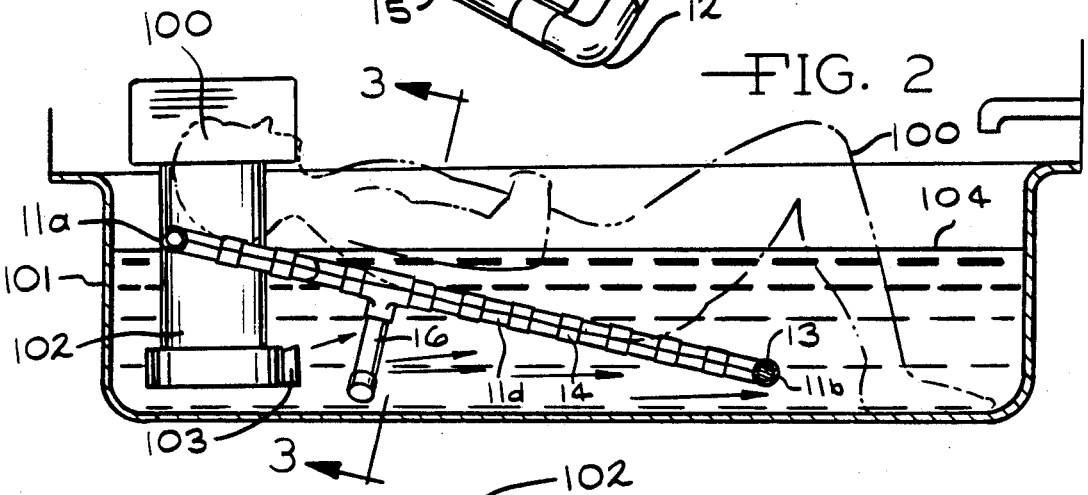
FIG. 2 is a front, cross-sectional view of the support apparatus of FIG. 1, particularly illustrating a patient 100 in dotted lines utilizing the support apparatus mounted in a tub 101, wherein the head, back and buttocks of the patient are supported in a single plane at an inclined angle.
Figure 3:
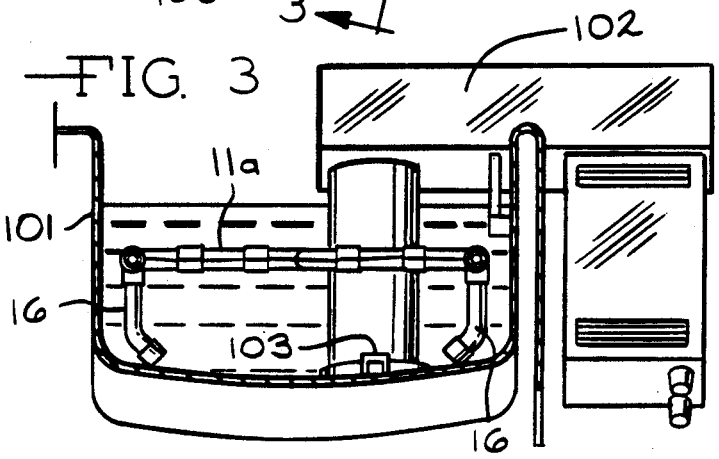
Figure 4:
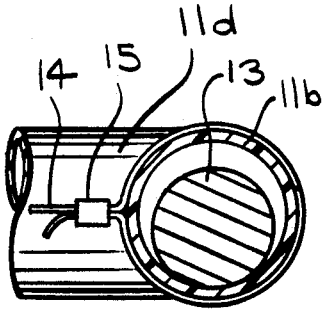
Figure 5A:
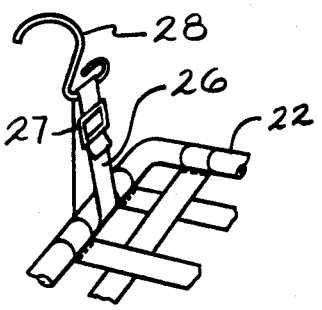
Figure 5:
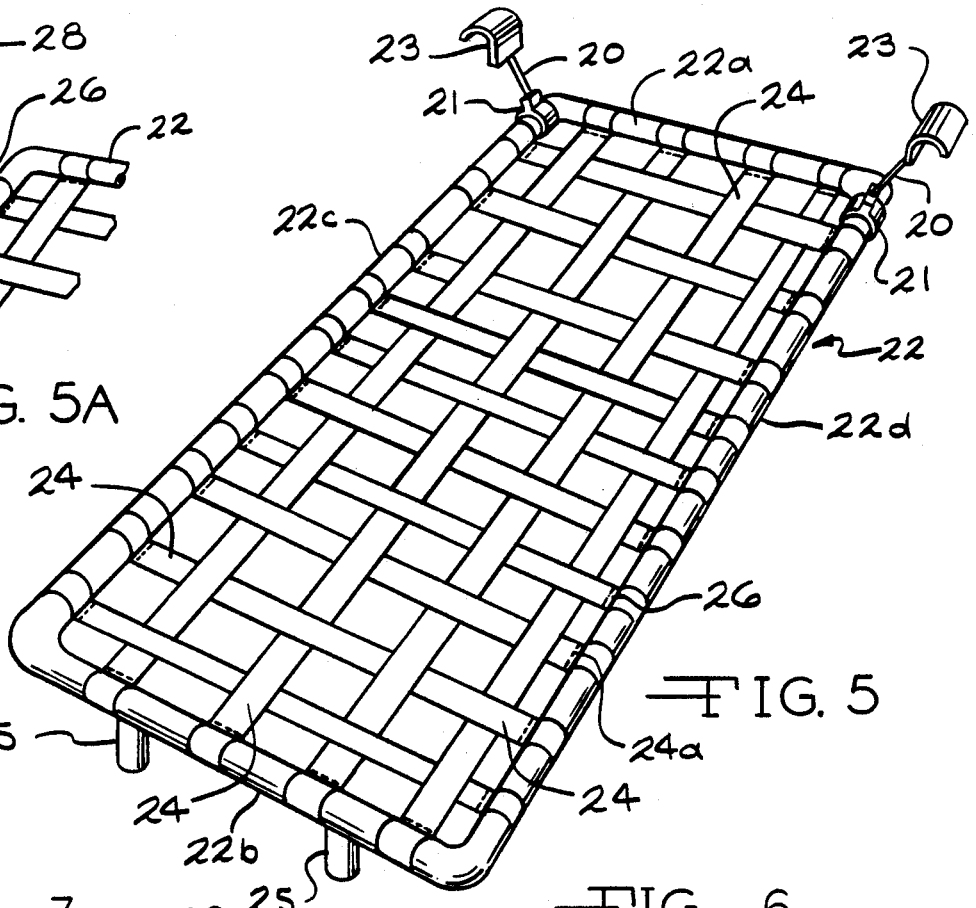

FIG. 3 is an end cross-sectional view along line 3—3 of FIG. 2 which illustrates the back support apparatus mounted in the tub 101 and more particularly illustrating how the pair of legs 16 are angled to fit the curvature in the bottom of the tub 101;

FIG. 4 is a sectional view along line 4—4 of FIG. 1 particularly illustrating a steel weight 13 which is inserted into the bottom rail **11*b* of the tubular frame 11** to prevent floating;

FIG. 5 is a perspective view of another preferred embodiment of the support apparatus of the present invention, particularly illustrating a pair of straps 20 including hooks 23 for attachment to a tub or tank 200 and also illustrating a pair of legs 25 for supporting the frame in the tub or tank;

FIG. 5A shows an alternate hook means using a strap 26 with a buckle 27 and a hook 28.

Figure 6:
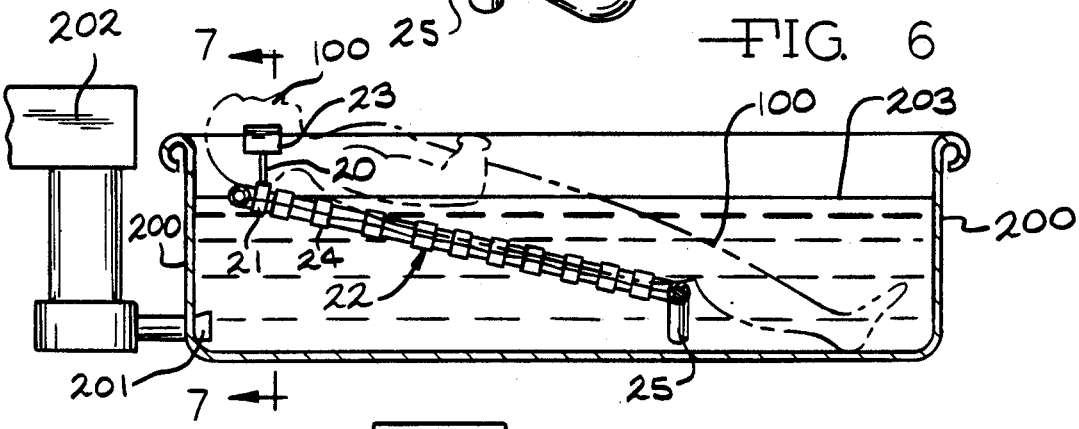
Figure 7:
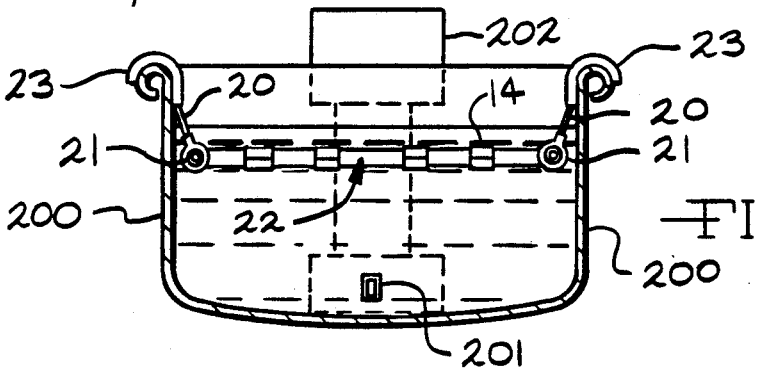

FIG. 6 is a front cross-sectional view of the support apparatus of FIG. 5, particularly illustrating a patient 100 utilizing the support apparatus which is mounted in a tank 200 where the head, back, and buttocks are in a single plane at an inclined angle; and FIG. 7 is a cross-sectional view along line 7—7 of FIG. 6, particularly illustrating the pair of straps 20 including the hooks 23 which are mounted to the side of the tank 200 and a pair of clamps 21 for mounting the straps to the side rails **22*c* and 22*d* of the tubular frame 22**.

GENERAL DESCRIPTION

The present invention relates to a support apparatus for supporting a patient while immersed in a water-filed hydrotherapy treatment tub or tank which comprises:

frame means positionable at an inclined angle in the tub or tank and which encircles the head, back and buttocks of the patient while leaving the legs of the patient unsupported; flexible webbing stretched across and attached to said frame means for supporting the head, back and buttocks of the patient wherein the webbing provides exposure of substantial portions of the back; and support means to be mounted on the tub or tank or mounted on the frame means for removably holding said frame means at the inclined angle adjacent a bottom portion of the tub or tank and enabling circulation of water through said flexible webbing onto the patient's back and passage of water under the frame means for recirculation.

The present invention also relates to a method for providing back treatment to a patient which comprises: support apparatus for supporting a patient while immersed in a water-filled hydrotherapy treatment tub or tank which comprises a frame means positionable at an inclined angle in the tub or tank and which encircles the head, back and buttocks of the patient while leaving the legs of the patient unsupported; flexible webbing stretched across and attached to said frame means for supporting the head, back and buttocks of the patient; and support means to be mounted on the tub or tank or mounted on the frame means for removably holding said frame means at the inclined angle and enabling circulation of water through said flexible webbing onto the patient's back and passage of water under the frame means for recirculation; and circulating of water through the flexible webbing and onto the patient's back and under the frame means.

SPECIFIC DESCRIPTION

Figure 1A:
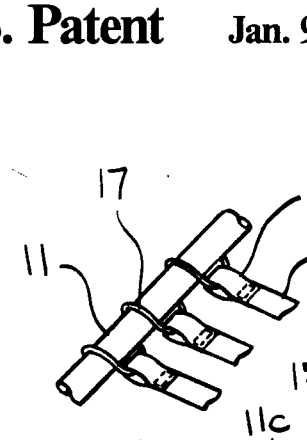

The patient support apparatus shown in FIGS. 1, 2 and 3, includes a tubular frame 11 having top and bottom rails 11*a* and 11*b* and opposed side rails 11*c* and 11*d*. The tubular frame 11 is joined together by a plurality of solvent welded elbow joints 12 at the top and bottom rails 11*a* and 11*b*. As shown in FIG. 3, the bottom of the tub 101 is curved and the rail 11*b* is straight so that a space is provided for water flow between the rail 11*b* and the bottom of the tub 101 as shown by the arrows in FIG. 2. A weight, such as the rod 13 (or sand) as shown in FIG. 4, is mounted inside the bottom rail 11*b* of the tubular frame 11. The tubular frame 11 is hollow and preferably constructed of plastic to prevent water damage. PVC pipe can be used for this purpose. Suitable flexible webbing 14, preferably nylon, is stretched across and attached to the tubular frame 11 by adjustable buckles 15. The flexible webbing 14, has open spaces so that water may readily flow through the webbing 14 to impinge on a patient's 100 back and buttocks. The buckle 15 provides a means for adjusting the tension of the webbing 14 so that sag of the webbing can be changed. It is preferred that there be no sag prior to any body weight on the webbing 14. A pair of legs 16 are mounted on the side rails 11*c* and 11*d* of the tubular frame 11 for supporting the back and buttocks of the patient 100 on an inclined angle preferably in the range of 10° to 35° from horizontal while immersed in a hydrotherapy treatment tub 101 as shown in FIG. 2. FIG. 1A shows a modified webbing 14*a* attached to frame 11 by means of a rope 17 through a loop 14*b* of the webbing 14*a*. FIG. 3 shows that the pair of legs 16 are angled to fit the curvature of the bottom of the tub 101. This construction preferably supports the patient's 100 back and lower torso on an inclined angle range of 10° to 35° providing effective treatment of the back and buttocks. FIGS. 2 and 3 show a conventional pump 102 with a nozzle 103 which directs the water 104 onto the patient's 100 back. Generally the water 104 is fanned upwards vertically and can be moved horizontally by adjusting the nozzle 103 which is moveable.

A support apparatus adapted for horizontal use is shown in FIGS. 5, 5A, 6 and 7 and includes a pair of support straps 20 with a clamp 21 for attaching the support straps 20 to the side rails 22*c* and 22*d* of a tubular frame 22 and U hooks 23 attached to a tank 200 for supporting the tubular frame 22. The straps 20 can be adjustable in length. The patient 100 is supported on flexible webbing 24 attached to top and bottom rails 22*a* and 22*b* and side rails 22*c* and 22*d* on an inclined angle range of 10° to 35° while immersed in a hydrotherapy treatment tank 200. The pump 202 provides water 203 through nozzle 201 inclined upwards at a slight angle from the horizontal. The webbing 24 is sewn together at 24*a* onto the frame 22. A pair of legs 25 are mounted on the bottom rail 22*b* of the tubular frame 22 enabling the water to circulate around the tubular frame 22 and onto the patient's 100 back and buttocks. The support straps 20 of the present invention can be constructed of a plastic or rubber coated chain so that the side of a hospital hydrotherapy tank is not scratched or marred from repeated patient 100 use.

FIG. 5A shows a strap 26 with a buckle 27 on the frame 22 and with a S hook 28 which attaches to the tub 200 as an alternate hook means.

The back support apparatus of the present invention functions by supporting a patient's 100 head, back and buttocks on an inclined angle range of 10° to 35° in a flat plane enabling the circulation of water 203 through the spaces in the flexible webbing 24 to impinge on the patient's 100 back and lower torso and to provide passage of water 203 under the tubular frame 22 for recirculation.

The flexible nylon webbing 14 which is stretched across and attached to the tubular frame 11 by adjustable buckles 15 could be attached to the tubular frame 11 by means of lacing sewn to flexible webbing and tied around the frame 11. A plurality of spaced apart stainless steel rods also could be welded to the steel tubular frame 11 and used to keep the webbing 14 in place. The nylon webbing is easily replaced and can be available in kit form.

The tubular frame 11 or 22 of the preferred embodiment is preferably constructed of 1" (2.54 cm) O.D. PVC pipe for use in a bathtub. The rod 13, which is inserted inside the bottom end of the tubular frame 11*a*, provides a weight pressure to hold down the bottom of the frame 11*a* in the tub or tank 105. The tubular frame 11 could also be constructed of 1" (2.54 cm) O.D. stainless steel for hospital use.

The support apparatus of the present invention also solves the problem of bacteria forming on the inside of the tubular frame 11. The tubular frame 11 is hollow and sealed which prevents contaminated water which has been used on the patient 100 from entering inside the frame 11 or 22.

It is intended that the foregoing description be only illustrative of the present invention and that the present invention be limited only by the hereinafter appended claims.

I claim:

1. A support apparatus for supporting a patient while immersed in a water filled bathtub for treatment of lower back pain which comprises:

(a) frame means with opposed top and bottom rails and opposed side rails positionable at an inclined angle in the bathtub wherein the rails define a single plane and wherein the frame means extends peripherally about the head, back and buttocks of the patient while leaving the legs of the patient unsupported and wherein a portion of the frame means adjacent the head is formed with a recess to allow positioning of a pump in the bathtub with nozzles directed at the back;

(b) flexible webbing stretched across and attached to said frame means for supporting the head, back and buttocks of the patient wherein the webbing is open so as to provide exposure of substantial portions of the back; and (c) a pair of leg supports mounted on the side rails of said frame means having a curved shape to fit a rounded bottom of the bathtub, wherein the leg supports hold the frame means at the inclined angle adjacent a bottom portion of the bathtub and wherein the bottom rail extends across the rounded bottom of the bathtub enabling circulation of water through the webbing onto the back of the patient and under the bottom rail of the frame means for recirculation.

2. The support apparatus in accordance with claim 1 wherein the frame means floats in water and wherein a weight is inserted at the bottom rail of the frame means for holding the bottom rail in the bathtub without floating.

3. The support apparatus in accordance with claim 1 wherein the leg supports mounts the frame means in the bathtub at an inclined angle in the range of 10° to 35° from horizontal.

4. The support apparatus in accordance with claim 1 wherein the frame means is a sealed tube.

5. The support apparatus in accordance with claim 4 wherein the sealed tube is constructed of a plastic material.

6. The support apparatus in accordance with claim 1 wherein the flexible webbing is constructed of a nylon material.

7. The support apparatus in accordance with claim 1 wherein the flexible webbing is constructed of nylon and includes buckles which adjustably secure the webbing to the frame means.

8. The support apparatus in accordance with claim 6 wherein the buckles are positioned adjacent to the side and top and bottom rails of the frame on the flexible webbing.

* * * * *